US005597027A

United States Patent [19]

Simon et al.

[11] Patent Number: 5,597,027

[45] Date of Patent: Jan. 28, 1997

[54] VENETIAN BLIND HAVING REPLACEABLE LADDER CORD COVERS

[75] Inventors: Terry Simon, West Olive, Mich.; Merrill Gitkin, Franklin Lakes; Frank Sowa, Pompton Lakes, both of N.J.

[73] Assignee: Jencraft Corporation, Totowa, N.J.

[21] Appl. No.: 551,483

[22] Filed: Nov. 1, 1995

[51] Int. Cl.[6] ..... E06B 9/30

[52] U.S. Cl. ..... 160/168.1; 160/178.3

[58] Field of Search ..... 160/168.1 R, 173 R, 160/172 R, 178.1 R, 178.3 R, 176.1 R, 177 R, 170 R

[56] References Cited

U.S. PATENT DOCUMENTS

| | | | |
|---|---|---|---|
| 2,105,937 | 1/1938 | White et al. . | |
| 2,130,320 | 9/1938 | Hammer | 160/178.1 R |
| 2,251,363 | 8/1941 | McGrew . | |
| 2,290,634 | 7/1942 | Clark, Jr. . | |
| 2,521,151 | 9/1950 | Cusick | 160/168.1 R |
| 2,527,104 | 10/1950 | Schaefer . | |
| 2,529,229 | 11/1950 | Sherwood . | |
| 2,537,865 | 1/1951 | Stuber et al. . | |
| 2,627,917 | 2/1953 | Lind | 160/173 R |
| 2,659,430 | 11/1953 | Lorentzen | 160/173 R |
| 2,756,816 | 7/1956 | Radel et al. | 160/173 R |
| 2,796,927 | 6/1957 | Evans . | |
| 2,868,284 | 1/1959 | Mason et al. | 160/173 R |
| 3,086,586 | 4/1963 | Wolfe . | |
| 3,265,117 | 8/1966 | Lorentzen et al. . | |
| 3,332,471 | 7/1967 | Croxen . | |
| 4,515,201 | 5/1985 | Anderson . | |
| 4,722,382 | 2/1988 | Vecchiarelli . | |

*Primary Examiner*—David M. Purol

*Attorney, Agent, or Firm*—Lerner, David, Littenberg, Krumholz & Mentlik

[57] ABSTRACT

A venetian blind includes replaceable ladder cord covers. The ladder cord covers may be constructed in a variety of widths to achieve an appropriate ornamental appearance, as well as being provided with decorative surfaces having a variety of motifs. The ladder cord covers may be color coordinated with the venetian blind to enhance its aesthetic appeal. The ladder cord covers are formed as elongated strips which are removably attachable by the user to the blind slats when and as desired.

53 Claims, 13 Drawing Sheets

VENETIAN BLIND HAVING REPLACEABLE LADDER CORD COVERS

BACKGROUND OF THE INVENTION

The present invention relates in general to window treatments of the venetian blind type, and more particularly, to replaceable ladder cord covers which enable the free alteration of the ornamental appearance of the venetian blind by covering the ladder cords with covers of different decorative designs and/or widths.

Venetian blinds are available in a plurality of shapes and sizes. In all cases, the venetian blind is constructed from a headrail which supports the operating assembly and a plurality of tiltable slats supported from the headrail by at least a pair of spaced apart ladder cords. The ladder cords are connected to a tilting mechanism within the headrail to enable the tilting of the slats to effect light control.

Today, ladder cords are available in a plurality of widths to provide different looks to the venetian blind. For example, the ladder cords may be in the nature of a single cord-like member or a wide flat tape ranging anywhere from one quarter to two inches in width. The particular width of the ladder cord must be specified at the time of purchase. Thereafter, the user can no longer alter the appearance of the venetian blind with a different ladder cord without having to purchase an entire new venetian blind. It is therefore desirable to provide the consumer with the ability to alter the appearance of the venetian blind by changing the ladder cords to ones of different widths or those having decorative appearance. One such venetian blind whose ornamental appearance may be altered by covering the ladder cords with covers of different decorative designs and/or widths is known from U.S. patent application Ser. No. 385,321 entitled, "Venetian Blind Having Replaceable Ladder Cord Covers" filed on Feb. 8, 1995, which application is assigned to the same assignee of the present application.

In Clark, Jr., U.S. Pat. No. 2,290,634 there is disclosed a venetian blind having a ladder tape over which there is laminated a paper layer such as crepe paper of various colors using a suitable adhesive. In McGrew, U.S. Pat. No. 2,251,363 there is disclosed a venetian blind which eliminates the use of ladder cords by providing outside bands which are detachable directly to the blind slats using snap ring holders. In White, et al., U.S. Pat. No. 2,105,937 there is known a venetian blind provided with ladder tapes to which there may be replaceably attached a facing tape for decorative purposes. The facing tape has its upper end affixed to a tilt bar which is suspended underlying a headrail. This arrangement can result in unsightly sagging or accumulation of the upper portion of the facing tape during the tilting operation of the slats. Accordingly, it can be appreciated that there is an unsolved need for replaceable ladder cord covers which enable the free alteration of the ornamental appearance of the venetian blind, while at the same time, maintaining proper appearance during the tilting operation of the slats.

SUMMARY OF THE INVENTION

It is one object of the present invention to provide a venetian blind which enables the user to alter the appearance of the venetian blind through the application of replaceable ladder cord covers.

Another object of the present invention is to provide a decorative replaceable ladder cord cover having an attachment element versatile to attach the cover to any existing mini blind or venetian blind, while providing a cover which looks and functions like a factory installed ladder tape.

Another object of the present invention is to provide a decorative replaceable ladder cord cover having an attachment element wherein the attachment element facilitates movement of the cover in conjunction with the slats as they rotate.

Another object of the present invention is to provide a decorative replaceable ladder cord cover having an attachment specifically designed to interface with a coordinating mini blind or venetian blind, while providing a cover which looks and functions like a factory installed ladder tape.

Another object of the present invention is to provide a decorative replaceable ladder cord cover having an attachment having at least one fastener constructed of polymer material of low Durometer to allow easy assembly to the ladder cord of any mini blind or venetian blind, while staying in place during operation of the blind, yet allowing for easy disassembly as desired.

Another object of the present invention is to provide a replaceable ladder cord cover having different widths and/or decorative appearance.

Another object of the present invention is to provide a replaceable ladder cord cover which is easy to install and remove by the user as desired.

In accordance with one embodiment of the present invention there is described a blind comprising a headrail, support means extending from the headrail for supporting a plurality of slats, cover means removably attachable overlying the support means for concealing a portion of the support means, and resilient means for attaching one end of the cover means to the headrail, whereby the cover means may be removed and replaced with another cover means.

In accordance with another embodiment of the present invention there is described a blind comprising a headrail, at least a pair of spaced apart ladder cords extending from the headrail supporting a plurality of slats, each of the ladder cords including at least one elongated vertical cord-like member extending along a common side of the blind, a pair of elongated strips having at least one fastener attached thereto for removably attaching the ladder cords at least partially overlying a corresponding one of the vertical members, and resilient means for attaching one end of the pair of elongated strips to the headrail, whereby the elongated strips may be removed and replaced with another strip.

In accordance with another embodiment of the present invention there is described a blind comprising a headrail, support means extending from the headrail for supporting a plurality of slats, cover means removably attachable to the support means for concealing a portion of the support means, at least one fastener provided on the cover means for releasably attaching the cover means to the support means, the fastener comprising a body having a slit communicating with a bore for receiving a portion of the support means through the slit into the bore, whereby the cover means may be removed and replaced with another cover means.

In accordance with another embodiment of the present invention there is described a ladder cord cover removably attachable to the ladder cord of a blind, the ladder cord cover comprising an elongated strip, at least one fastener for removably attaching the strip to the ladder cord overlying at least a portion thereof, and resilient means for attaching one end of the cover means to the headrail, whereby the strip may be removed from the ladder cord and replaced with another strip.

In accordance with another embodiment of the present invention there is described a ladder cord cover removably attachable to the ladder cord of a blind, the ladder cord cover comprising an elongated strip, and at least one fastener for removably attaching the strip to the ladder cord overlying at least a portion thereof, the fastener comprising a body having a slit communicating with a bore for receiving a portion of the ladder cord therein, whereby the strips may be removed from the ladder cord and replaced with another strip.

BRIEF DESCRIPTION OF THE DRAWINGS

The above description, as well as further objects, features and advantages of the present invention will be more fully understood with reference to the following detailed description of a venetian blind having replaceable ladder cord covers, when taken in conjunction with the accompanying drawings, wherein.

DETAILED DESCRIPTION OF THE PREFERRED EMBODIMENTS

Figure 1:
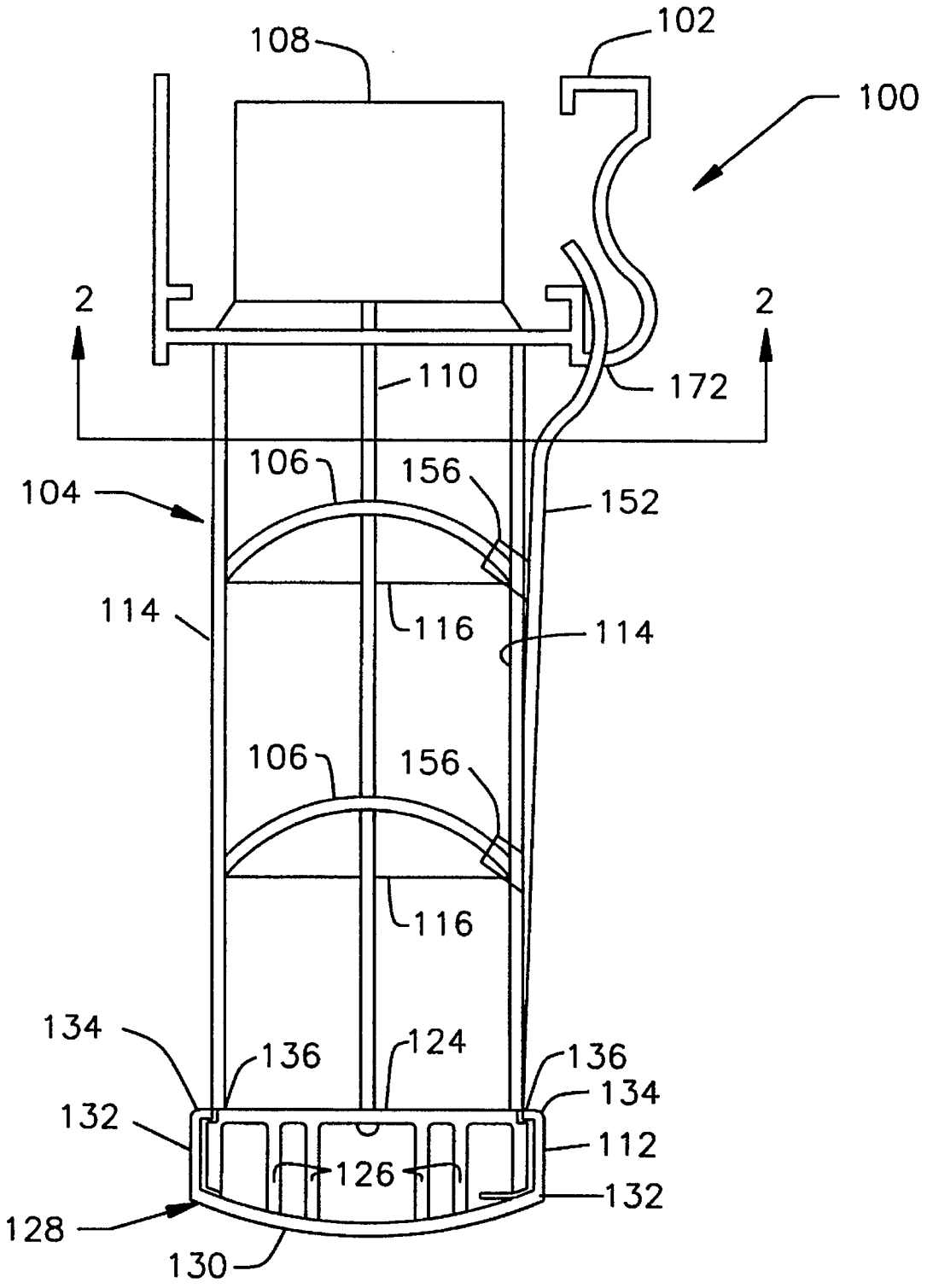
FIG. 1 is a side elevational view of a venetian blind constructed in accordance with one embodiment of the present invention.

Referring now to the drawings, wherein like reference numerals represent like elements, there is shown in FIG. 1 a venetian blind constructed in accordance with one embodiment of the present invention and designated generally by reference numeral 100. The venetian blind 100 is constructed from an elongated headrail 102 from which there is suspended one or more spaced apart ladder cords 104 for supporting a plurality of slats 106. An operating assembly 108 is positioned within the headrail 102 for adjusting the orientation of the slats 106, as well as raising and lowering the slats by means of a lift cord 110. The lower ends of the ladder cords 104 and lift cord 110 are attached to a bottom rail 112. The operating assembly 108 may be constructed in a variety of forms, for example, see U.S. application Ser. No. 350,316 entitled "Low Profile Venetian Blind", filed on Dec. 2, 1994 and assigned to the same Assignee of the present application.

The ladder cords 104 are constructed from a pair of spaced apart elongated members 114 horizontally interconnected by a plurality of equally spaced apart support members 116. The support members 116 are operative for supporting a respective slat 106 which includes aligned openings (not shown) through which there is threadably received the lift cord 110. Although the members 114 of the ladder cords 104 may be constructed as cord-like members, they may also be constructed as flat tapes of varying width.

Figure 2:
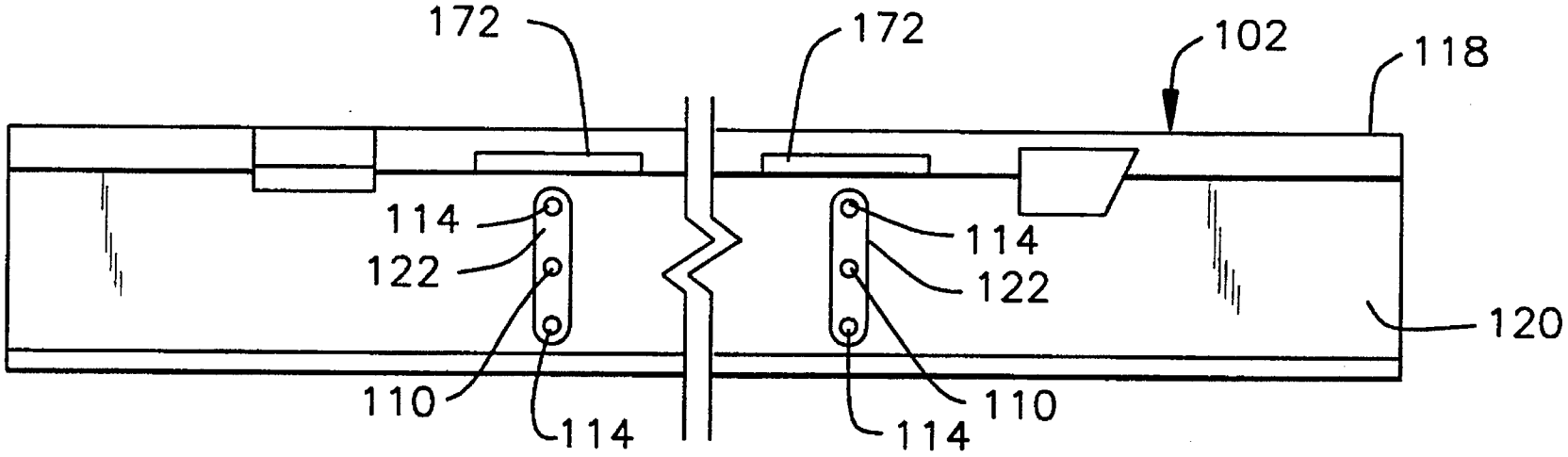
FIG. 2 is a bottom plan view of a venetian blind headrail adapted for accommodating replaceable ladder cord covers.

As shown in FIG. 2, the headrail 102 is constructed from an elongated body 118 having a bottom wall 120 provided with two spaced apart slots 122 arranged transverse to the longitudinal axis of the headrail. The slots 122 are arranged in alignment with the location of the ladder cords 104. In this regard, the free ends of the ladder cords 104, i.e., the members 114, as well as the lift cord 110, extend through their respectively aligned slot 122 for connection to the operating assembly 108. The other free ends of the ladder cords and lift cords 110 are attached to the bottom rail 112.

The bottom rail 112 as shown in FIG. 1 is constructed from an elongated planar member 124 from which there downwardly depends a plurality of spaced apart ribs 126 having a curved outer profile. An elongated cover 128 is adapted to be releasably secured over the ribs 126. In this regard, the cover 128 is provided with a curved bottom wall 130 having the same radius as the outer ends of the ribs 126. A pair of spaced apart sidewalls 132 extend upwardly from the bottom wall 130 and are provided with inwardly turned flanges 134. The flanges 134 are adapted to be captured within notches 136 extending along the sides of the planar member 124. Accordingly, the free ends of the ladder cords 104 are secured to the bottom rail by being captured about the outermost ribs 126 by means of the sidewalls 132 of the cover 128 when secured thereon by the flanges 134 being received within the notches 136. The lift cord 110, on the other hand, is threadably received through an opening (not shown) within the planar member 124 and formed with a knot or other suitable means for securing the lift cord thereat.

Figure 3:
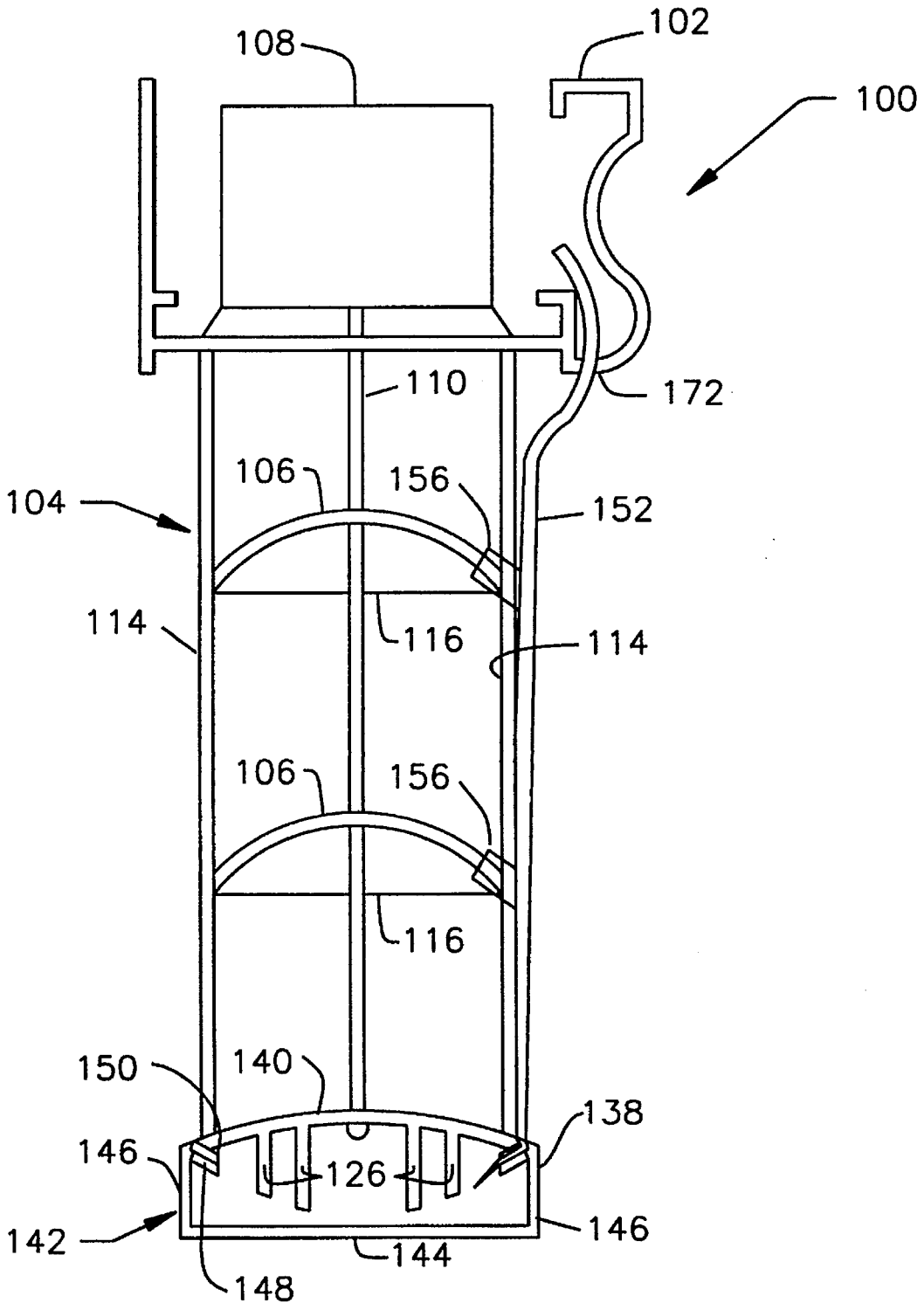
FIG. 3 is a side elevational view of a venetian blind constructed in accordance with another embodiment of the present invention having replaceable ladder cord covers.
Figure 4:
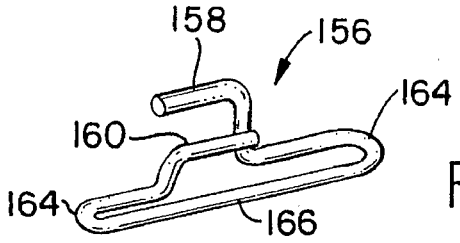
FIGS. 4–7 are various illustrations of a fastener in the nature of a hook for removably attaching the replaceable ladder cord covers directly to the slats of a venetian blind.

Referring now to FIG. 3, there is shown another embodiment of a bottom rail 138 in accordance with the present invention. The bottom rail 138 has a reverse profile from the bottom rail 112 as shown in FIG. 1. In this regard, the planar member 140 has a curved profile while the cover 142 has a generally flat bottom wall 144. The sidewalls 146 of the cover 142 have inwardly and downwardly directed flanges 148 to be captured within longitudinally extending corresponding grooves 150 adjacent the lateral edges of the planar member 140. The releasable attachment of the cover 142 to the planar member 140 is operative for attaching both the free ends of the ladder cord 104 and ladder cord cover 152 thereto.

Figure 5:
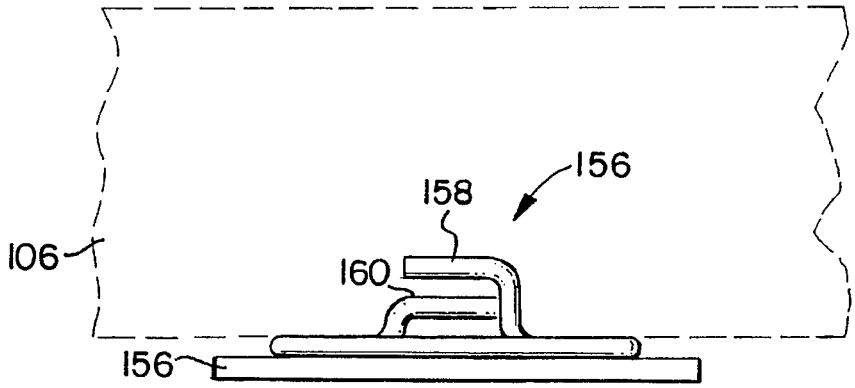
Figure 13:
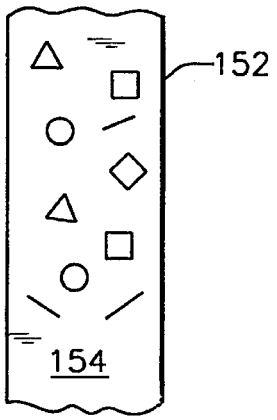
FIG. 13 is a front elevational view of a replaceable ladder cord cover having a decorative surface in accordance with one embodiment of the present invention.

Referring now to the Figs. in general, various embodiments of a replaceable ladder cord cover 152 will be described. As shown in FIGS. 1 and 5, the ladder cord cover 152 is constructed as an elongated flat tape extending from within the bottom rail 112 to within the headrail 102. The ladder cord cover 152 can be constructed from a variety of widths to provide the venetian blind 100 with a different ornamental appearance as may be desired by the user. For example, the width of the ladder cord cover 152 may range from one quarter of an inch to two inches or more as may be desired for a particular effect. The ladder cord cover 152 may be constructed from a variety of materials having suitable texture and color to complement the venetian blind 100. For example, the ladder cord cover 152 may be a solid color in the same or contrasting with that of the slats 106. In addition, the ladder cord cover 152 may have a variety of smooth or textured surfaces, weaves and the like to provide a specific ornamental appearance. In addition, the surface of the ladder cord cover 152, as shown in FIG. 13, may be decorated with an infinite number of patterns and/or motifs. As shown, the outer surface 154 is provided with a decorative geometric pattern. However, it is possible to have various motifs such as holidays, birthdays, seasons, special occasions or the like.

The ladder cord cover 152 can be attached directly to the slats 106 in a variety of manners. For example, as shown in FIGS. 4–7, the ladder cord cover 152 may be provided with a plurality of hooks 156 spaced apart along the longitudinal length thereof. In this regard, each of the hooks 156 are constructed from a resilient articulated member of metal or plastic material which may easily be manufactured in mass quantities. Each hook 156 is constructed from a pair of parallel spaced apart legs 158, 160 defining an opening 162 therebetween. The legs 158, 160 are connected by respective U-shaped ends 164 which connect to a straight segment 166. The hooks are attached at spaced apart locations along the longitudinal length of the ladder cord cover 152 facing the slats 106. The hooks 156 are releasably attached to a corresponding slat 106 by receiving an edge portion thereof within the opening 162 formed between the parallel spaced apart legs 158, 160. Preferably, the width of the opening 162 is narrower than the thickness of the corresponding slat 106 thereby securing same which is facilitated by the resilient nature of the hook construction.

Figure 6:
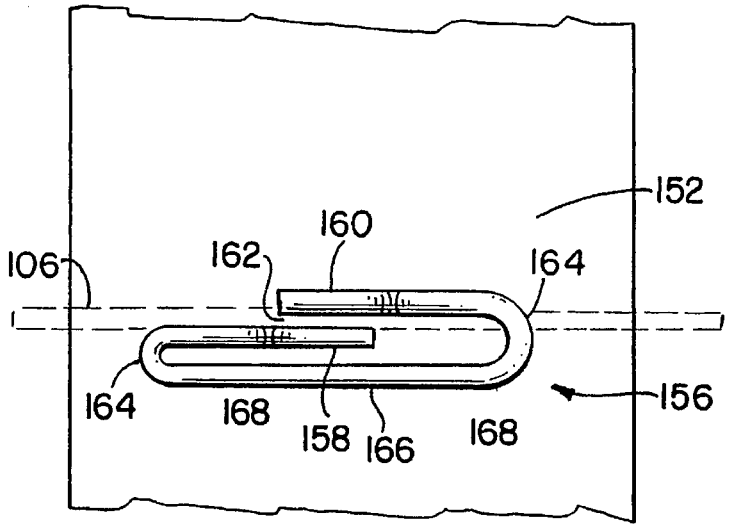
Figure 7:
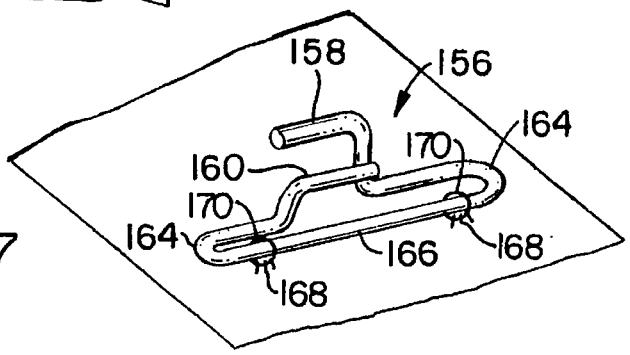

The hooks 156 can be attached to the ladder cord covers 152 in a variety of manners. Preferably, it is desirable that the hooks 156 be pivotable or rotational about their point of attachment to the ladder cord cover 152 so as to accommodate the tilting of the slats 106 during operation of the venetian blind 100. As shown in FIG. 6, the hooks 156 are pivotably attached to the ladder cord cover 152 by loose stitches 168 provided along the length of the straight segment 166. The stitching 168 holds the hooks 156 in position, while enabling free rotation about the straight segment 166 to accommodate tilting of the slats 106. In another embodiment as shown in FIG. 7, a pair of spaced apart enlarged rings 170 are positioned along the straight segment 166 and secured to the ladder cord cover 152 by similar stitching 168. It is to be understood that other hook constructions and manner of attaching same to the ladder cord covers may be employed without departing from the spirit of the present invention.

Referring once again to FIG. 1, the free ends of the ladder cord cover 152 after attachment by the hooks 156 to the slats 106 are secured to the bottom rail in a similar manner as the free ends of the ladder cord 104. In this regard, the ladder cord cover 152 has its free end captured between the outer most rib 126 of the bottom rail 112 and the sidewall 132 of the cover 128. The other free end of the ladder cord cover 152 extends upwardly (see FIG. 2) and freely through an aligned elongated slot 172 within the bottom wall 120 of the headrail 102 thereby hiding the free end. By means of this arrangement, the operation of the venetian blind 100 will not be interfered with by the presence of the ladder cord cover 138. In addition, the ladder cord cover 138 will appear to have been originally installed on the venetian blind 100 to retain the high quality look of the venetian blind.

Figure 8:
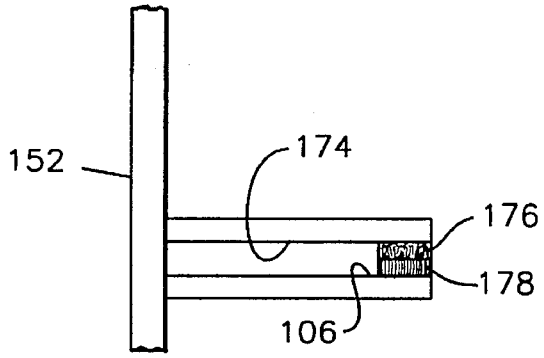
FIG. 8 is a side elevational view of another embodiment for removably attaching a ladder cord cover directly to the slats of a venetian blind.

With reference to FIGS. 8–12, alternative embodiments for releasably attaching the ladder cord cover 152 to a slat 106 will now be described. Referring to FIG. 8, the ladder cord cover 152 is provided with a flexible strip 174 to which there is attached at its free end the male or female component 176 of Velcro material. The other male or female Velcro component 178 is secured to the underlying surface of an adjacent slat 106 preferably adjacent its outer edge. The strip 174 may be constructed from a variety of materials, such as those of the ladder cord cover 152, as well as in a variety of widths. The Velcro material 176, 178 may also be replaced by a releasable adhesive for securing the free end of the strip 174 to the slat 106.

Figure 9:
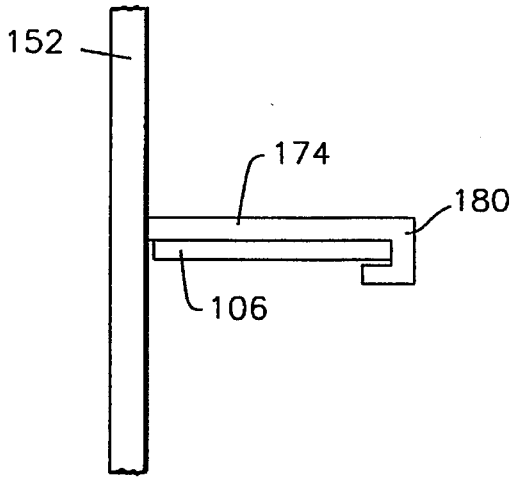
FIG. 9 is a side elevational view of another embodiment for removably attaching a ladder cord cover directly to the slats of a venetian blind.
Figure 10:
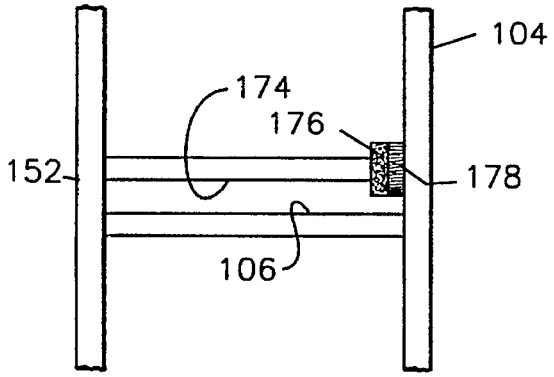
FIG. 10 is a side elevational view of another embodiment for removably attaching a ladder cord cover to the ladder cord of a venetian blind.

In the embodiment shown in FIG. 9, the strip 174 is provided with a hook 180 at its free end to capture the rear edge of the slat 106. In this regard, the strip 174 can be constructed from a variety of materials, including elastic-type materials which will provide slight tension in order to maintain the hook 180 in its engaged position. As shown in FIG. 10, the male and female Velcro components 176, 178 may be used to attach the ladder cord cover 152 via strip 174 to the opposing ladder cord 104. In the embodiment in FIG. 11, the strip 174 is elongated so as to wrap around the slat 106 to enable the free end thereof to secure itself to the ladder cord cover 152 via the male and female Velcro components, one of which is previously attached to the ladder cord cover.

Figure 12:
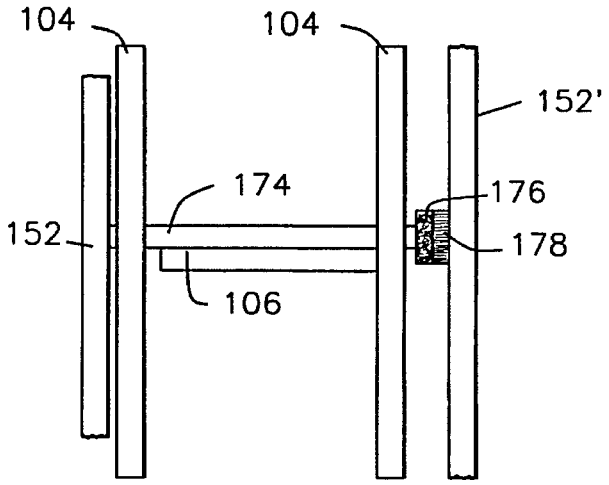
FIG. 12 is a side elevational view of another embodiment for removably attaching a ladder cord cover to the slats of a venetian blind.
Figure 11:
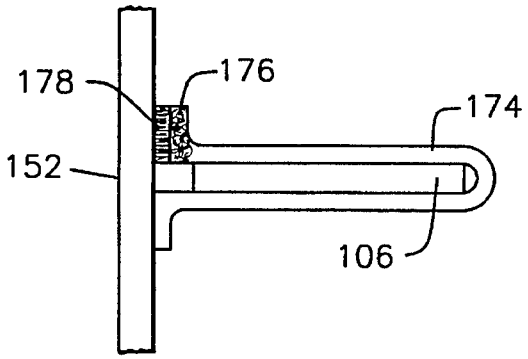
FIG. 11 is a side elevational view of another embodiment for removably attaching a ladder cord cover via an opposing second ladder cord cover to a venetian blind.

In the embodiment shown in FIG. 12, a front and rear ladder cord cover 152, 152[1] are joined together using the strip 174 using the male and female Velcro components 176, 178, one of which is previously attached to the inner surface of the ladder cord cover 152[1]. In this manner, the decorative ladder cord cover may be viewed from both sides of the venetian blind. In consideration of the foregoing, it is to be understood that the male and female Velcro components 176, 178 may be replaced by other suitable connectors such as hooks, wire clips, adhesive material and the like.

Figure 14:
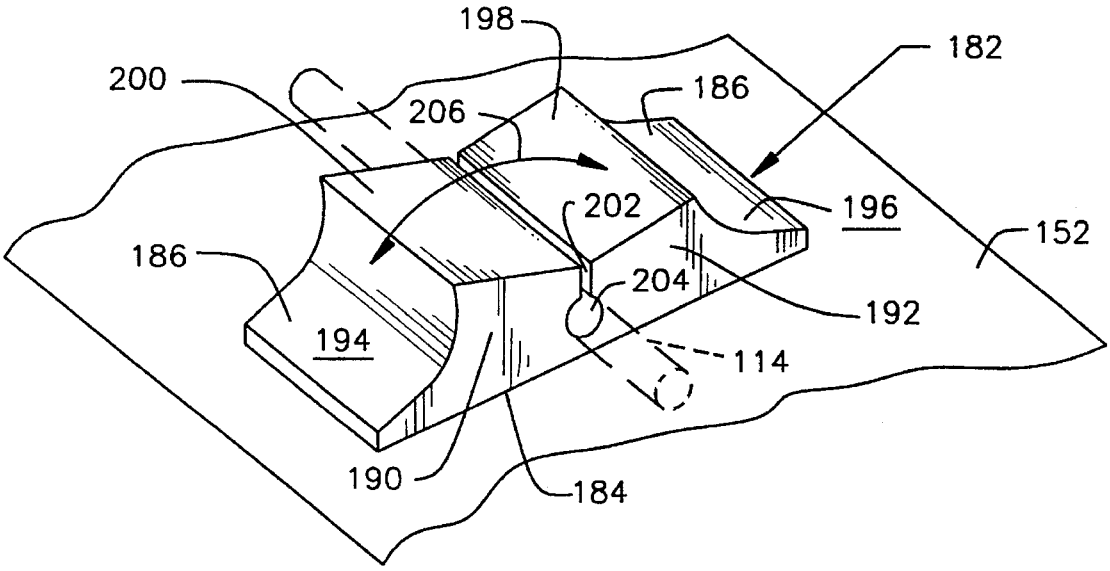
FIG. 14 is a perspective view of one embodiment of a fastener for removably attaching the ladder cord covers to a cord-like ladder cord of a venetian blind.

In accordance with the preferred embodiment of the present invention, it is preferred that the ladder cord covers 152 be removably attached directly to the elongated cord-like members 114 of the ladder cords 104. The ladder cord covers 152 may be releasably secured to the members 114 using a plurality of clips 182 which are adhered in spaced apart relationship along the longitudinal length of the ladder cord covers. The preferred construction of one such clip 182 is shown in FIG. 14. The clip 182 can be constructed from a variety of synthetic and natural materials such as polymeric materials, natural rubber or synthetic rubber and the like. It is preferred that the material selected for the clip 182 have a sticky texture which is often a characteristic of rubber-like materials. By providing a sticky texture, the clip will grab and adhere to a greater degree to the members 114 of the ladder cords 104 than clips constructed of harder type plastic materials which have a lower surface coefficient of friction. This sticky texture of the clips 182 will facilitate the clips staying in place once in their attached position. By way of example, the clips 182 may be constructed of urethane materials, and more preferably soft polyvinylchloride materials, and most preferably those having a low Durometer.

The clip 182 has a generally flat base 184 forming a pair of spaced apart tabs 186, 188 at either end thereof. Located between the tabs 186, 188 is a pair of enlarged upstanding body portions 190, 192 provided with convex side surfaces 194, 196 coextensive with tabs 186, 188 and inwardly directed sloped top surfaces 198, 200. The sloped top surfaces 198, 200 are separated by a narrow transversely arranged elongated slit 202 which communicates with an enlarged underlying cylindrical bore 204 transversely extending between the body portions 190, 192. The bore 204 is generally sized to have a diameter slightly smaller than the effective diameter of the members 114 of the ladder cords 104.

The clips 182 may be secured to the surface of the ladder cord covers 152 by any suitable means, such as adhesive, stapling, stitching, thermal bonding, two way tape, etc. A plurality of clips 182 are secured to the ladder cord covers 152 in spaced apart relationship with their slits 202 in longitudinal alignment. The clips 182 are attached to the members 114 of the ladder cords 104 by forcing the members through the restricted slits 202 so as to be captured within the bores 204. The aligning of the members 114 with the slits 202 is facilitated by the inwardly sloping surfaces 198, 200 which tend to automatically guide the members toward the slit. Once aligned with the slit 202, the clip 182 may be pressed inwardly so as to force the members 114 through the slit into the bore 204. Forcing the members 114 through the slits 202 is facilitated by the resilient nature of the clips 182 resulting from their material of construction and their ability to bow in a manner which enlarges the slit 202.

As shown in FIG. 14, the clip 182 may be bowed, see Arrow 206, by bending backwards upon the tabs 186, 188. As the tabs 186, 188 are bent backwards, the clip 182 will bow slightly so as to open and enlarge the slit 202 to facilitate receipt of the member 114 therethrough. The clip 182 is allowed to return to its normal condition upon release of the tabs 186, 188. Due to the restricted size of the bore 204, it will engage the member 114 to secure same for releasably attaching the ladder cord covers 152 thereto. As previously noted, the sticky nature of the material of the clip 182 will facilitate grabbing of the member 114 within the bore 204. In addition, it is also contemplated to construct the clip 182 of materials having a higher Durometer whereby they are not classified as sticky materials, as well as being less flexible. In this event, the reduced size of the bore 204 will also provide a compressive force upon the members 114 so as to maintain their secured position. The clips 182 may be removed from the members 114 by reversing the aforementioned operation. In particular, the clips 182 may be bowed once again using tabs 186, 188 so as to enlarge slot 202 to enable passage of the members 114 therethrough. From the foregoing description, it should be appreciated that the clips 182 enable the easy attachment and removal of the ladder cord covers 152 to and from a secured position with respect to the ladder cords 104.

Figure 15:
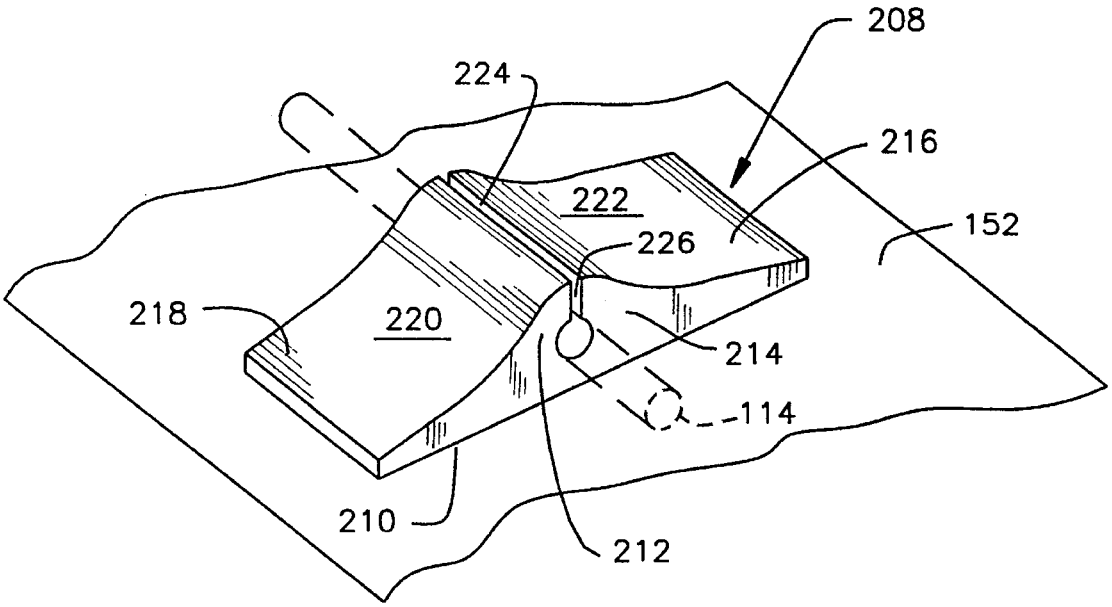
FIG. 15 is a perspective view of another embodiment of a fastener for removably attaching the ladder cord covers to a cord-like ladder cord of a venetian blind.

Referring to FIG. 15, there is disclosed another embodiment of a clip 208 in accordance with the present invention. The clip 208 is formed to include a base 210 from which there upwardly extends a pair of body portions 212, 214 defining outer tabs 216, 218 having curved surfaces 220, 222. The body portions 212, 214 are transversely separated by a narrow slit 224 which communicates with an enlarged bore 226. The members 114 may be captured within bore 226 by operation of the clip 208 in the manner as previously described with respect to the clip 182. In this regard, the clip 208 may be bowed so as to enlarge slit 224 to enable passage of the member 114 into the bore 226. The clip 208 may be constructed from similar materials as clip 182, enabling the clip to be bowed, or in the case of harder polymer materials, the member 114 may be forced or snapped through the slit 202, 224. It will be appreciated that due to the absence of the sloped surfaces 198, 200 in clip 208, there is no structure which will guide the member 114 toward the slit 224 as in the case with clip 182. It is therefore required that the slit 224 be aligned with the member 114 by the user so as to be inserted through the slit 224 into the bore 226.

The particular width and length of the clips 182, 202 will be dictated by the width of the ladder cord covers 152 and effective size of the members 114. In general, by providing the clips 182, 208 of larger widths, the bores 204, 226 will be of increased length. The longer the bores 204, 226 the greater the amount of surface area for grabbing and holding the members 114.

As shown in FIGS. 1 and 3, the upper end of the ladder cord covers 152 extend freely through a slot 172 within the headrail 102. It has, however, been found that the upper end of the ladder cord covers 152 may tend to slip downward under its own weight thereby providing a slight bulge or bunching up of the ladder cord cover underlying the headrail 102. In addition, as the slats 106 are tilted downwardly toward a closed orientation, the tilting action will pull the upper portion of the ladder cord covers 152 downwardly and slightly out from within the headrail 102. When the slats 106 are tilted back to their horizontal position, often the ladder cord cover 152 will not be extended back into the headrail 102 to the extent of its original position. This will result in the ladder cord covers 152 remaining bunched up directly underneath the headrail 102.

Figure 17:
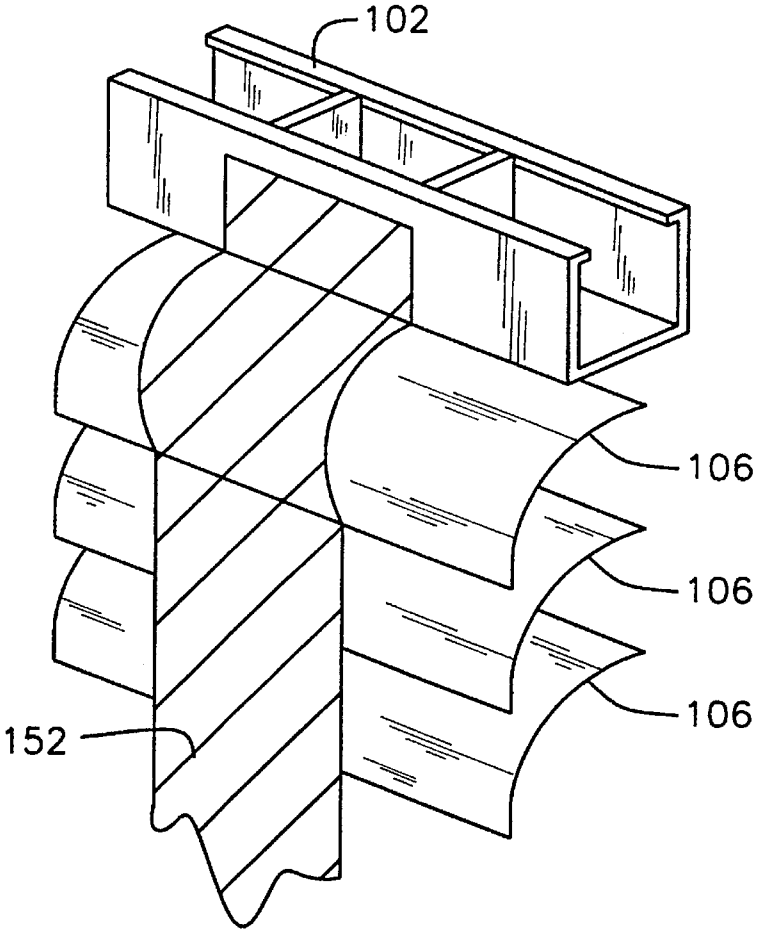
FIGS. 16 and 17 are perspective views showing a ladder cord cover directly attached to the headrail of a venetian blind.
Figure 16:
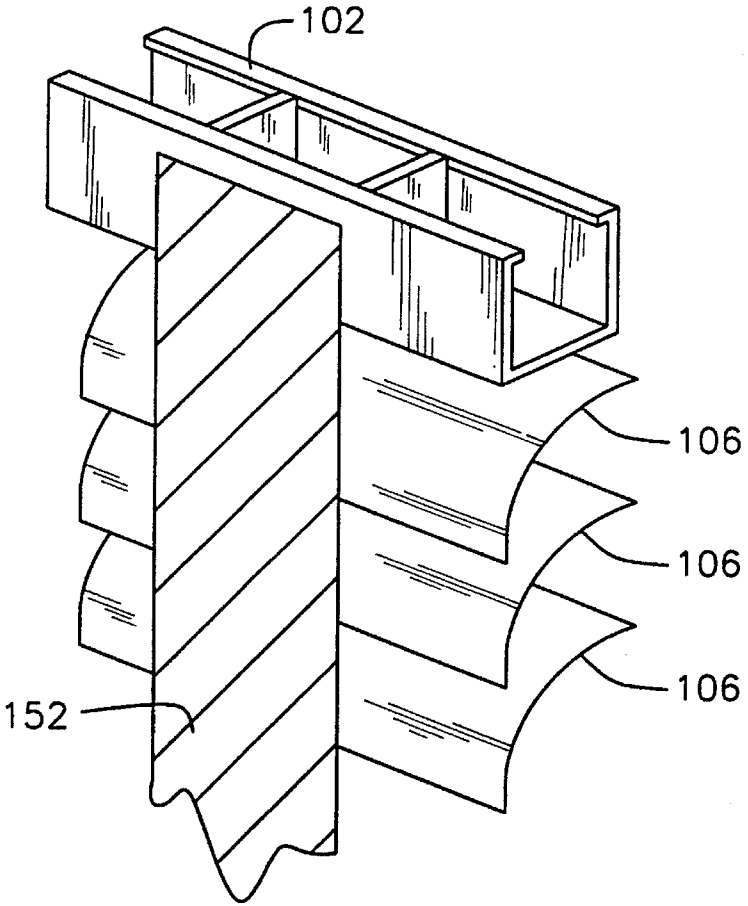

In an alternative embodiment as shown in FIG. 16, the free end of the ladder cord cover 152 may be directly attached to the outer surface of the headrail 102 using a suitable adhesive or the like so as to lie flat when the slats are in a fully closed orientation. This attachment arrangement, however, will also result in the bunching up of the upper portion of the ladder cord cover 152 during the tilting operation of the slats 106 back to their horizontal orientation. As shown in FIG. 17, as the slats 106 are tilted back to their horizontal orientation, that portion of the ladder cord cover 152 immediately under the headrail 102 will bulge outwardly due to the bunching up of the excess material created by the tilting operation as the outer edge of the uppermost slat 106 gets closer to the headrail 102. In addition, this arrangement may restrict the slat operation when tilting the slats 106 in the opposite direction to a fully closed position. Although the thus far described arrangements provide operative ladder cord covers 152, there is the desire to provide an attachment technique which will avoid the bulging or bunching up of material forming the ladder cord covers 152 directly underlying the headrail 102, as well as facilitating the slat tilting operation. To this end, the present invention provides a number of arrangements which will overcome the aforementioned problem.

In overcoming the aforementioned deficiencies, the present invention broadly contemplates the attaching of the upper free end of the ladder cord covers 152 to the headrail 102 by some form of resilient member. By resilient member, it is generally intended to refer to some form of resilient, elastic or spring-like element which will allow the upper portion of the ladder tape covers 152 to stretch and return to their original position during the tilting operation of the slats 106, thereby remaining flat at all times. This is generally achieved by maintaining the upper portion of the ladder cord covers 152 under tension. There will now follow the description of a number of specific embodiments to achieve the foregoing objectives of the present invention.

Figure 18:
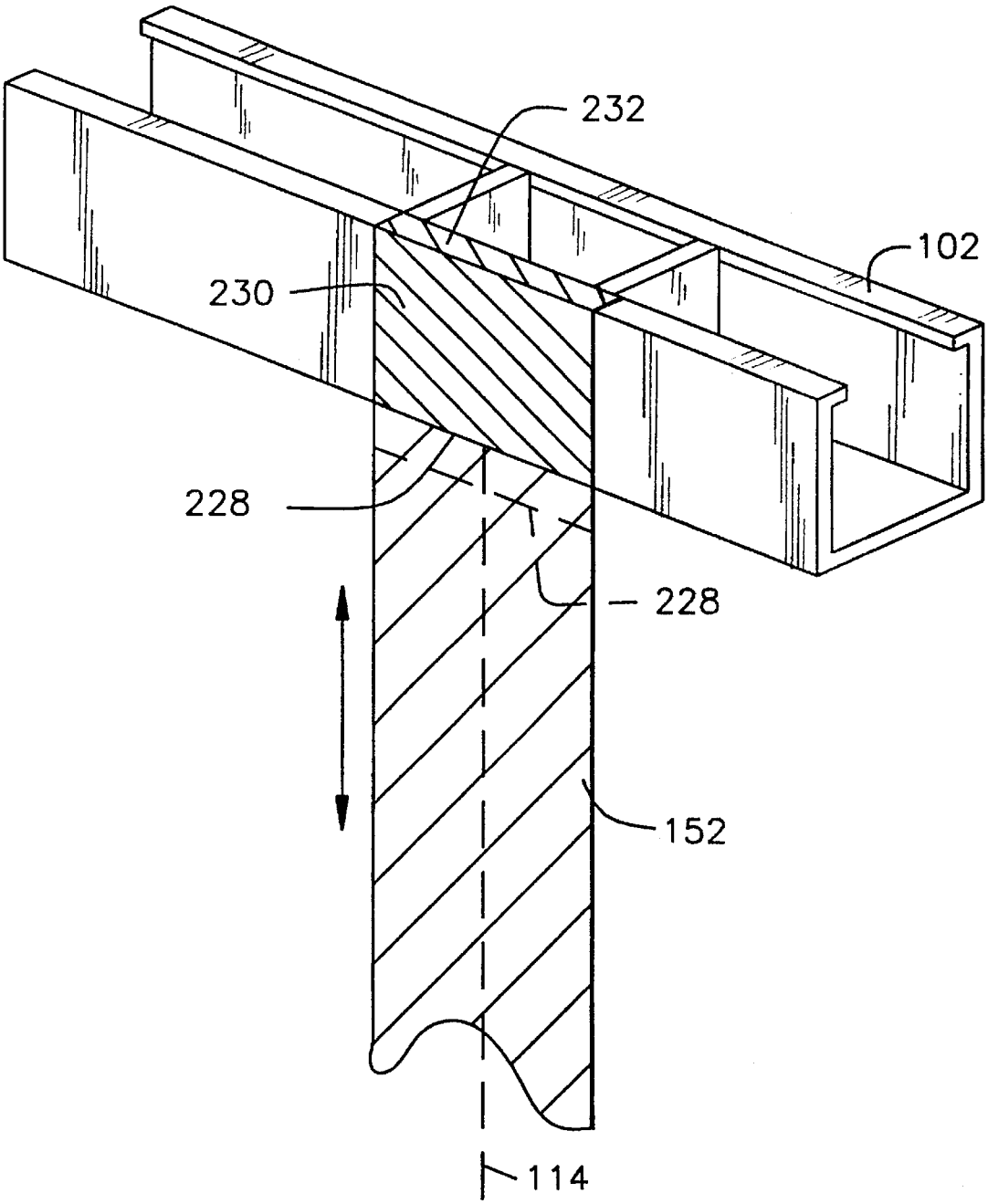
FIG. 18 is a perspective view of a ladder cord cover attached to the headrail of a venetian blind by a resilient member in accordance with one embodiment of the present invention.

Referring to FIG. 18, the free end 228 of the ladder cord cover 152 is attached to an elastic member 230 such as by stitching, stapling, gluing, thermal bonding, and the like. The elastic member 230 may be constructed of a number of suitable elastic materials so as to provide the requisite resiliency which will maintain the ladder cord cover 152 under tension during the tilting operation. In particular, the elastic member 230 may be constructed from known elastic polymer materials, spandex, or the like. The upper end 232 of the elastic member 230 may be adhesively attached to the flange 234 of the headrail 102. In the alternative, the upper end 232 may be adhesively attached to the inside wall of the headrail 102 or along the top outer facing edge of the headrail. Still further, it is contemplated that the upper end 232 may be provided with one or more clips (not shown) to attach same to the flange 234 or other portion of the headrail 102.

Although the elastic member 230 has been disclosed as a separate element from the ladder cord cover 152, it is also possible to be integrally formed therewith. For example, the entire ladder cord cover 152 may be constructed from resilient material such as spandex or the like. In addition, it is contemplated that spandex-like threads may be sewn into the upper free end of the ladder cord cover 152 or otherwise attached thereto so as to provide the requisite resiliency and elastic characteristics pursuant to the present invention. In this regard, as the slats 206 are tilted downwardly from a horizontal orientation toward a closed orientation, the free end 228 of the ladder cord cover 152 will be displaced downwardly against the action of the elastic member 230 to its location as indicated by the dashed lines. At such time, the ladder cord cover 152 will be maintained under tension by means of the elastic member 230. Upon return of the slats 106 to its original horizontal orientation, the free end 228 of the ladder cord cover 152 will be pulled upwardly by the resilient action of the elastic member 230 to its original location to eliminate any bunching up or excess material that might otherwise be present as previously described. Accordingly, the elastic member 230 is operative for maintaining the free end of the ladder cord cover 152 under tension and overcoming the aforementioned deficiencies of attaching the ladder cord cover directly to the headrail or loosely within a slot 172 as previously described. The elastic member 230 will typically be concealed by a valance (not shown) which is normally installed by the user.

Figure 19:
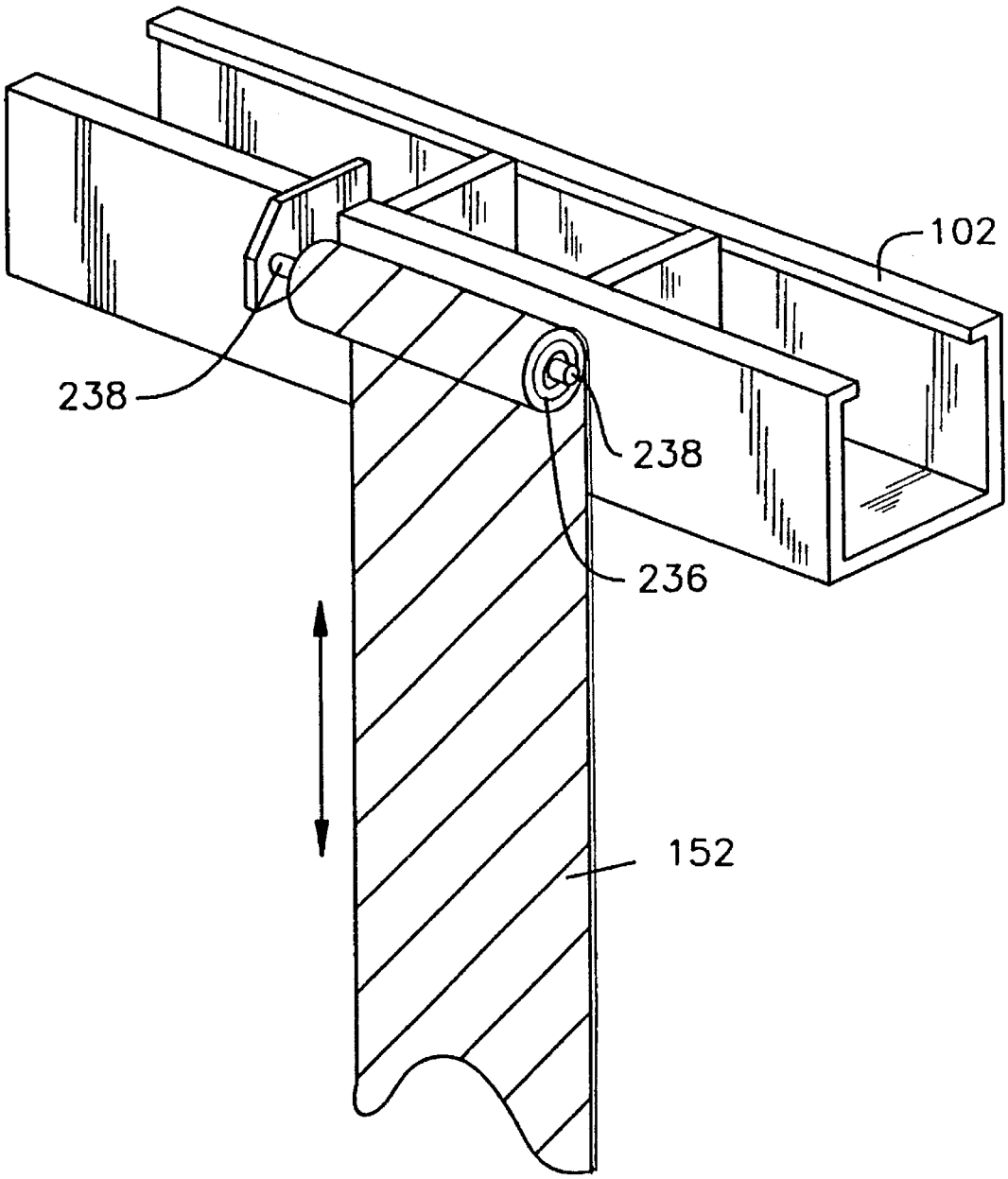
FIG. 19 is a perspective view of a ladder cord cover attached to the headrail of a venetian blind by means of a spring roller assembly in accordance with another embodiment of the present invention.

Referring now to FIG. 19, there is disclosed a spring roller assembly 236 operative for preventing the free end of the ladder cord cover 152 from bunching up. The spring roller assembly 236 is, in essence, a miniature version of a spring roller assembly typically found in window roll-up shades and the like. The opposing pins 238 of the spring roller assembly 236 are journaled within a pair of brackets 240, only one of which is shown, which may be clipped onto the front wall of the headrail 102. The mounting brackets 240 may alternatively be secured to the inside surface of a valance, to an extension of the mounting brackets for the headrail 102 and the like. As in the case of the window shade, the upper free end of the ladder cord cover 152 is wound about the spring roller assembly 236 and secured thereto. As the slats 106 tilt downwardly, the ladder cord cover 152 will be unwound from the spring roller assembly 236 while being maintained under tension. As the slats 106 are tilted back into their normal horizontal position or therebeyond, the spring roller assembly 236 will function to wind the excess ladder cord cover 152 thereabout thereby preventing any bunching up of the ladder cord cover.

Figure 20:
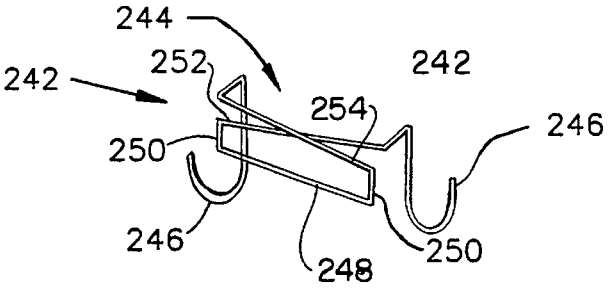
FIG. 20 is a perspective view of a resilient member in the nature of a spring clip for attaching a ladder cord cover to the headrail of a venetian blind in accordance with another embodiment of the present invention.

Referring now to FIG. 20, there is disclosed a resilient spring clip 242 operative for attaching the ladder cord cover 152 in accordance with the preferred embodiment of the present invention. The spring clip 242 is constructed from a central open rectangular frame assembly 244 from which there is attached a U-shaped member 246 at either side thereof. The frame assembly 244 is constructed from a single lower cross-bar 248 which is connected at either end by spaced side members 250 to a respective one of a pair of upper cross-bars 252, 254. The U-shaped members 246 are respectively attached to the upper cross-bars 252, 254 and arranged in a common plane parallel to and spaced from the plane containing the frame member 244. The spring clip 242 may be constructed from a variety of resilient spring-like metal materials which are known in the construction of compression and tension springs.

Figure 21:
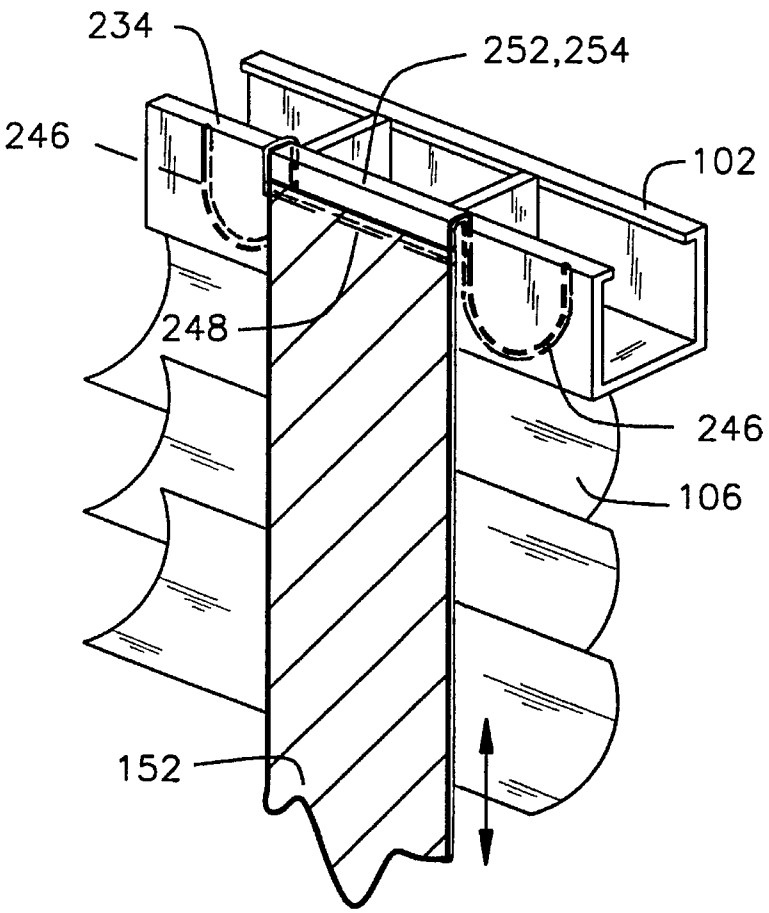

Referring to FIG. 21, the spring clip 242 is attached to the upper free end of the ladder cord cover 152 by folding a portion thereof through the frame assembly 244 and down over the cross-bar 248, securing same by adhesive, thermal bonding, stitching, stapling or the like. In this attached arrangement, the U-shaped members lie in a plane parallel to and slightly spaced behind a plane containing the ladder cord cover 152. The spring clip 242 is operative for releasably attaching the ladder cord cover 152 to either the outside or inside of the headrail 102 as now to be described.

Figure 22:
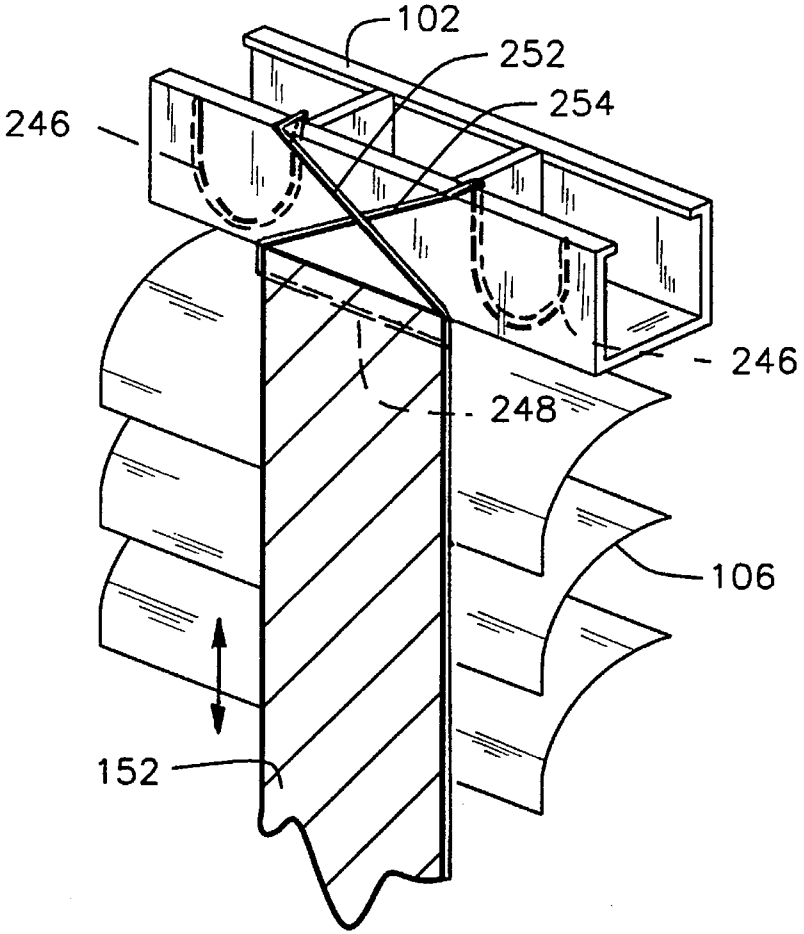
FIGS. 21 and 22 are perspective views showing the use of the spring clip in accordance with the present invention for resiliently attaching the ladder cord cover to the exterior of a headrail of a venetian blind.

As shown in FIGS. 21–22, the spring clip 242 removably attaches the upper end of the ladder cord cover 152 to the outside of the headrail 102. The spring clip 242 is positioned on the outside of the headrail 102 with the U-shaped members 246 being received within the headrail adjacent the inner surface of the front wall. In this position, the upper free ends of the U-shaped members 246 are generally captured under the flanges 234 which extend inwardly of the headrail 102. The upper end of the ladder cord cover 152 is maintained under slight tension due to the spring-like action of the spring clip 242.

When the slats 106 are tilted downward, see FIG. 22, the ladder cord cover 152 also is displaced downwardly against the action of the spring clip 242. This motion causes the upper cross-bars 252, 254 to separate in a scissors-type action as shown. The resilient nature of the spring clip 242 maintains the ladder cord cover 152 under slight tension. As the slats 106 are rotated back through 180° to a closed position, see FIG. 21, the spring clip 242 due to its spring-like action will return the upper end of the ladder cord cover 252 to its original flat position. It can therefore be appreciated that the spring clip 242 will prevent the bunching up of the upper portion of the ladder cord cover 152 during the tilting operation through a complete 180° of operation as shown in FIGS. 21 and 22.

Figure 23:
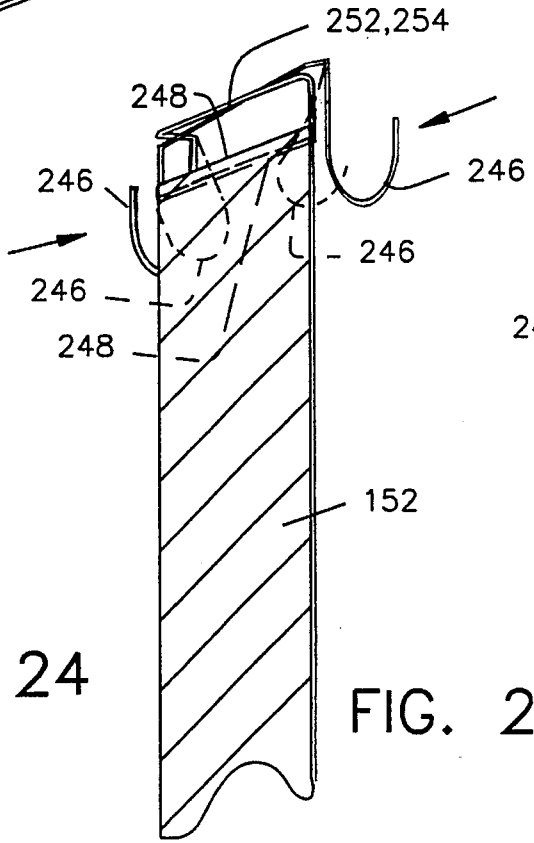
FIGS. 23 and 24 are perspective views showing the use of the spring clip in accordance with the present invention for resiliently attaching the ladder cord cover to the interior of a headrail of a venetian blind.
Figure 24:
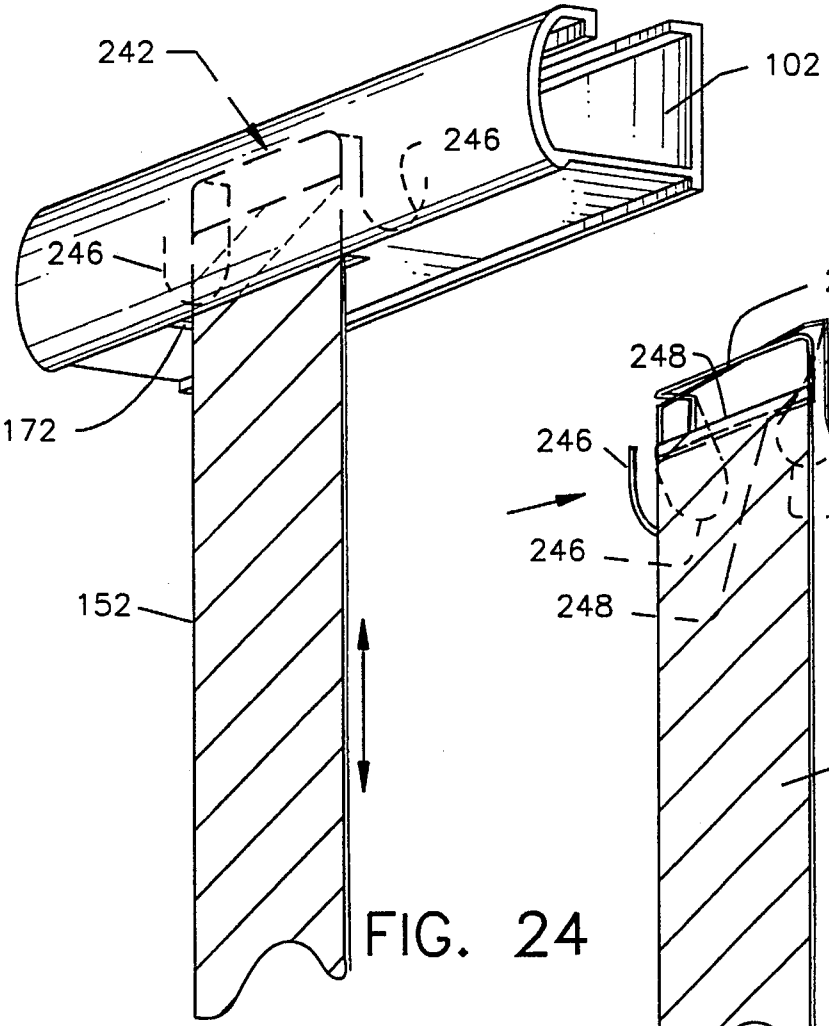

In the embodiment shown in FIGS. 23–24, the ladder cord cover 152 is attached by the spring clip 242 internally within the headrail 102 via slot 172. To effect installation, the U-shaped members 246 are initially squeezed inwardly in the direction of the arrows so as to displace same behind the lateral extent of the ladder cord cover 152. The ability to displace the U-shaped members 246 is facilitated by the resilient nature of the spring clip 242. This position is shown in dashed lines in FIG. 23. At this time, the upper end of the spring clip 242 and the ladder cord cover 152 may be inserted through the slot 172 within the bottom wall of the headrail 102. Once through the slot 172, pressure may be released from the U-shaped members 246 to allow them to return to their original outward position as shown in dashed lines in FIG. 24. The bottom curved portions of the U-shaped members 246 are now supported by the bottom wall of the headrail 102. As the slats 106 are tilted, the ladder cord cover 152 is displaced downwardly against the tension created by the spring clip 242. The operation of the spring clip 242 is as thus far described with respect to FIGS. 21 and 22 so as to prevent the bunching up of the ladder cord cover 152 directly under the headrail 102.

Figure 25:
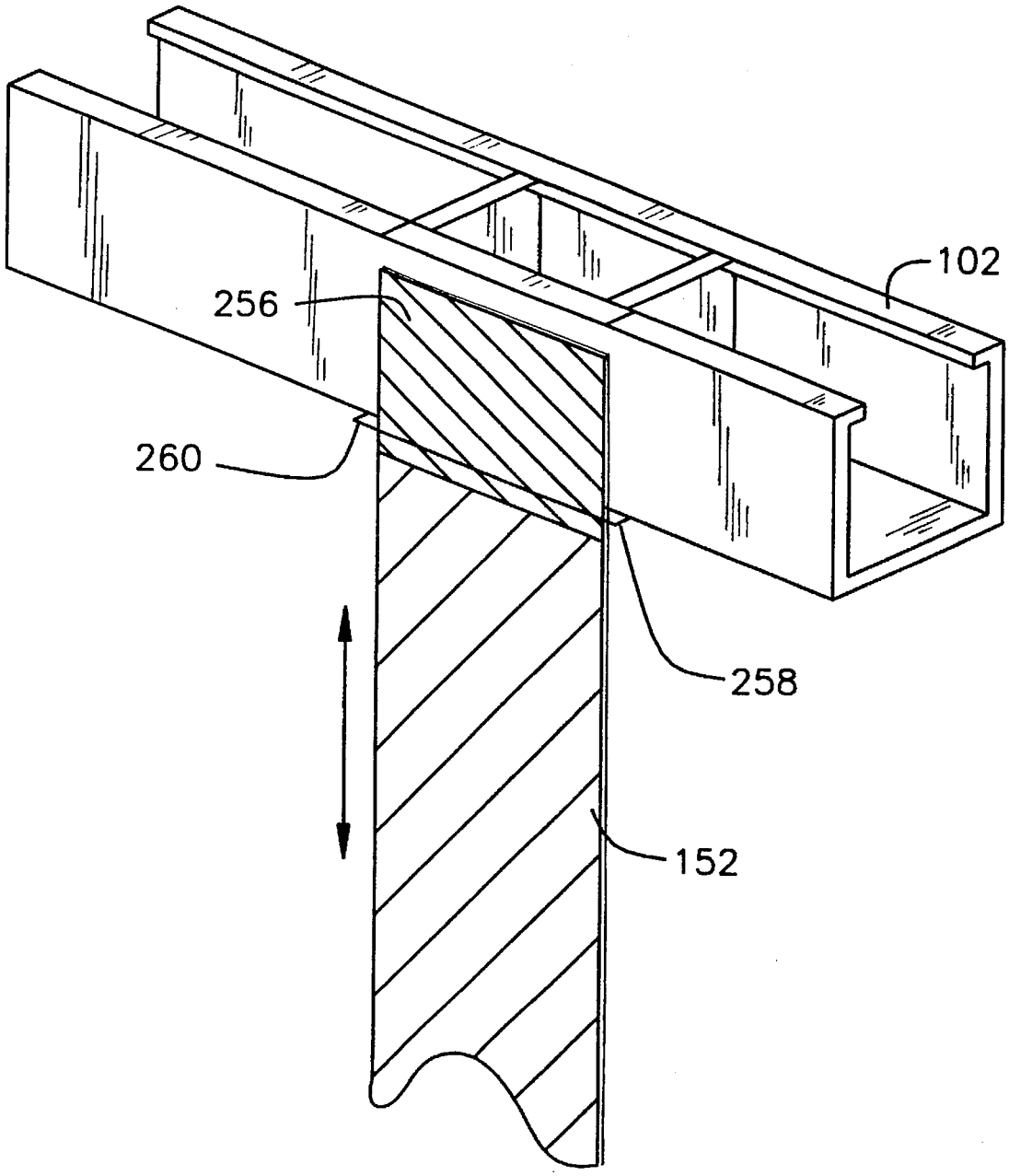
FIG. 25 is a perspective view showing the use of a retainer wire for attaching a ladder cord cover to the headrail of a venetian blind in accordance with another embodiment of the present invention.

In accordance with another embodiment as shown in FIG. 25, the upper portion 256 of the ladder cord cover 152 may be rendered relatively stiff with respect to the remaining portion of the ladder cord cover by a variety of techniques. For example, the upper portion 256 of the ladder cord cover 152 may be laminated with plastic material, dipped into setable polymer material, heat pressed to partially melt the material to form a more solid layer or the like. The foregoing, renders the upper portion 256 relatively stiff compared to the rest of the ladder cord cover 152. The ladder cord cover 152 is retained by the use of a retainer wire 258 which is attached to the bottom or sidewall of the headrail 102 to provide a narrow elongated forward opening 260. The upper portion 256 of the ladder cord cover 152 is inserted through the opening 260 so as to overlie the sidewall of headrail 102. As the slats 106 are tilted, the upper portion 256 of the ladder cord cover 152 will slide up and down through the opening 260. By virtue of the retainer wire 258 and the upper portion 256 being constructed of relatively stiff material, the upper portion will not bunch up, but rather slide up and down through the opening 260.

Figure 26:
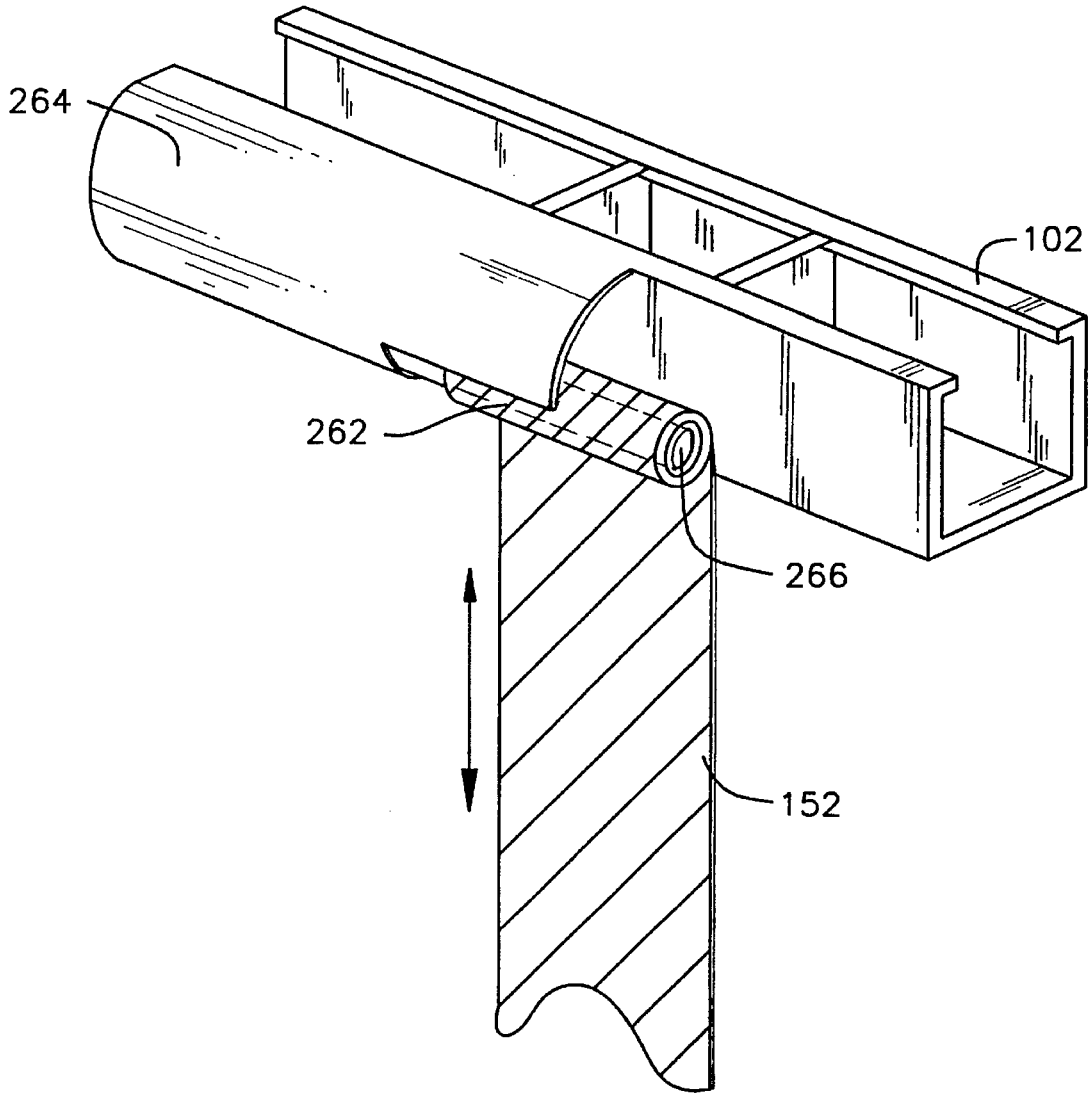
FIG. 26 is a perspective view of a ladder cord cover having a memory retained coiled end supported by a portion of a valance in accordance with another embodiment of the present invention.

In the embodiment shown in FIG. 26, the upper portion 262 of the ladder cord cover 152 is formed into a coil and rendered semi-rigid in order to make the upper portion retain its coiled shape. This can be achieved by heat treating the upper portion 262, particularly when the ladder cord cover 152 is constructed from polymer materials, application of setable polymer materials, laminating, and the like. As the slats tilt, the ladder cord cover 152 forming the upper portion 262 will unroll and re-roll itself to prevent bunching up underlying the headrail 102. This allows the remaining exposed portion of the ladder cord cover 152 to remain taut. To facilitate the unrolling and re-rolling of the upper portion 262, the valance 264 may be provided with a rod 266 about which the upper portion is coiled.

The invention as thus far described has disclosed various embodiments of resiliently attaching the upper portion of the ladder cord cover 152 to the headrail 102. With respect to the bottom portion of the ladder cord covers 152, they may be attached to the bottom rail 112 as disclosed with respect to FIGS. 1 and 3. In addition, the ladder cord cover 152 may be attached to the bottom rail 112 by adhesive, such as two-way tape, or any other suitable means to enable its easy removal upon replacement of the ladder cord cover 152.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A blind comprising a headrail, support means extending from said headrail for supporting a plurality of slats, cover means removably attachable overlying said support means for concealing a portion of said support means, and resilient means for attaching one end of said cover means to said headrail, whereby said cover means may be removed and replaced with another cover means.

2. The blind of claim 1, wherein said cover means comprises an elongated strip.

3. The blind of claim 1, wherein said cover means includes at least one fastener for removably attaching said cover means to said support means.

4. The blind of claim 3, wherein said fastener is constructed of material selected from the group consisting of urethanes, polyvinylchlorides, natural rubbers and synthetic rubbers.

5. The blind of claim 3, wherein said fastener comprises a body having a slit communicating with a bore for receiving a portion of said support means therein.

6. The blind of claim 5, wherein said slit has an opening smaller than the effective size of said support means.

7. The blind of claim 6, wherein said body is constructed of resilient material to enable the flexing of said fastener to increase the opening of said slit to allow the passage of said support means therethrough into said bore.

8. The blind of claim 6, wherein said bore has an effective size smaller than the effective size of said support means.

9. The blind of claim 1, wherein said resilient means comprises a spring clip.

10. The blind of claim 1, wherein said resilient means comprises an elastic member.

11. The blind of claim 10, wherein said elastic member comprises elastic material integral with at least the upper portion of said cover means.

12. The blind of claim 1, wherein said resilient means comprises a spring roller assembly having the upper portion of said cover means attached thereto.

13. The blind of claim 1, further including a bottom rail supported by said support means, wherein the other end of said cover means is attached to said bottom rail.

14. The blind of claim 1, wherein said headrail includes an opening, said cover means having a portion extendable into said headrail through said opening to conceal the end thereof.

15. The blind of claim 14, wherein said resilient means comprises a spring clip securing said portion of said cover means within the interior of said headrail.

16. A blind comprising a headrail, at least a pair of spaced apart ladder cords extending from said headrail supporting a plurality of slats, each of said ladder cords including at least one elongated vertical cord-like member extending along a common side of said blind, a pair of elongated strips having at least one fastener attached thereto for removably attaching said ladder cords at least partially overlying a corresponding one of said vertical members, and resilient means for attaching one end of said pair of elongated strips to said headrail, whereby said elongated strips may be removed and replaced with another strip.

17. The blind of claim 16, wherein said fastener comprises a body having a slit communicating with a bore for receiving a portion of said cord-like member therein.

18. The blind of claim 17, wherein said slit has an opening smaller than the effective size of said cord-like member.

19. The blind of claim 17, wherein said body is constructed of resilient material to enable the flexing of said fastener to increase the opening of said slit to allow the passage of said cord-like member therethrough into said bore.

20. The blind of claim 17, wherein said body includes opposing sloping surfaces directed toward said slit for guiding said cord-like member thereto.

21. The blind of claim 16, wherein said fastener is constructed of polymer material.

22. The blind of claim 16, wherein said fastener is constructed as a wire clip.

23. The blind of claim 16, wherein said resilient means comprises a spring clip.

24. The blind of claim 23, wherein said spring clip comprises a frame assembly to which there is attached a U-shaped member at either side thereof.

25. The blind of claim 24, wherein said frame assembly comprises a lower cross-bar and a pair of upper cross-bars respectively attached to one of said U-shaped members.

26. The blind of claim 23, wherein said spring clip facilitates movement of at least the upper portion of said strips in conjunction with said slats as said slats are rotated.

27. The blind of claim 16, wherein said resilient means comprises a spring roller assembly having the upper portion of said strip attached thereto.

28. The blind of claim 16, wherein said resilient means comprises an elastic member.

29. The blind of claim 28, wherein said elastic member comprises elastic material integral with at least the upper portion of said strip.

30. The blind of claim 16, further including a bottom rail supported by said support means, wherein the other end of said strip is attached to said bottom rail.

31. The blind of claim 16, wherein said headrail includes an opening, said strip having a portion extendable into said headrail through said opening to conceal the end thereof.

32. The blind of claim 31, wherein said resilient means comprises a spring clip securing said portion of said strip within the interior of said headrail.

33. A blind comprising a headrail, support means extending from said headrail for supporting a plurality of slats, cover means removably attachable to said support means for concealing a portion of said support means, at least one fastener provided on said cover means for releasably attaching said cover means to said support means, said fastener comprising a body having a slit communicating with a bore for receiving a portion of said support means through said slit into said bore, whereby said cover means may be removed and replaced with another cover means.

34. The blind of claim 33, wherein said cover means comprises an elongated strip.

35. The blind of claim 33, wherein said slit has an opening smaller than the effective size of said support means.

36. The blind of claim 33, wherein said body is constructed of resilient material to enable the flexing of said fastener to increase the effective size of said slit to allow the passage of said support means therethrough.

37. The blind of claim 33, wherein said body includes opposing sloping surfaces directed toward said slit for guiding said support means thereto.

38. The blind of claim 33, further including resilient means for removably attaching one end of said cover means to said headrail.

39. The blind of claim 38, wherein said resilient means comprises a spring clip.

40. The blind of claim 33, wherein the upper portion of said strip has been stiffened in comparison to the remaining portion of said strip.

41. The blind of claim 40, further including means for providing a slot adjacent said headrail for receiving the stiffened portion of said strip.

42. The blind of claim 40, wherein the stiffened portion of said strip is arranged in a coil.

43. The blind of claim 42, further including means for receiving said coil adjacent said headrail.

44. A ladder cord cover removably attachable to the ladder cord of a blind, said ladder cord cover comprising an elongated strip, at least one fastener for removably attaching said strip to said ladder cord overlying at least a portion thereof, and resilient means for attaching one end of said cover means to said headrail, whereby said strip may be removed from said ladder cord and replaced with another strip.

45. The ladder cord cover of claim 44, wherein said fastener comprises a body having a slit communicating with a bore for receiving a portion of said ladder cord therein.

46. The ladder cord cover of claim 45, wherein said body is constructed of resilient material to enable the flexing of said fastener to increase the effective size of said slit to allow the passage of said ladder cord therethrough into said bore.

47. The ladder cord cover of claim 45, wherein said body includes opposing sloping surfaces directed toward said slit for guiding said ladder cord thereto.

48. The ladder cord cover of claim 44, wherein said resilient means comprises a spring clip.

49. The ladder cord cover of claim 48, wherein said spring clip comprises a frame assembly to which there is attached a U-shaped member at either side thereof.

50. The ladder cord cover of claim 49, wherein said frame assembly comprises a lower cross-bar and a pair of upper cross-bars respectively attached to one of said U-shaped members.

51. A ladder cord cover removably attachable to the ladder cord of a blind, said ladder cord cover comprising an elongated strip, and at least one fastener for removably attaching said strip to said ladder cord overlying at least a portion thereof, said fastener comprising a body having a slit communicating with a bore for receiving a portion of said ladder cord therein, whereby said strips may be removed from said ladder cord and replaced with another strip.

52. The ladder cord cover of claim 51, wherein said body is constructed of resilient material to enable the flexing of said fastener to increase the effective size of said slit to allow the passage of said ladder cord therethrough into said bore.

53. The ladder cord cover of claim 51, wherein said body includes opposing sloping surfaces directed toward said slit for guiding said ladder cord thereto.

* * * * *